United States Patent [19]

Scheuchzer et al.

[11] Patent Number: 4,621,460

[45] Date of Patent: Nov. 11, 1986

[54] MACHINE FOR RESHAPING RAIL HEADS

[75] Inventors: Frédy Scheuchzer, Lausanne; Fritz Buehler, Ecublens, both of Switzerland

[73] Assignee: Les Fils d'Auguste Scheuchzer S.A., Lausanne, Switzerland

[21] Appl. No.: 610,383

[22] Filed: May 15, 1984

[30] Foreign Application Priority Data

May 17, 1983 [EP] European Pat. Off. ..... 83200699.3

[51] Int. Cl.[4] ..... E01B 31/17

[52] U.S. Cl. ..... 51/178

[58] Field of Search ..... 51/178

[56] References Cited

U.S. PATENT DOCUMENTS

| | | | |
|---|---|---|---|
| 2,035,154 | 3/1936 | Faries | 51/178 |
| 3,358,406 | 12/1967 | Speno, Jr. et al. | 51/178 |
| 3,945,152 | 3/1976 | Helgemeir | 51/178 |
| 4,091,578 | 5/1978 | Panetti | 51/178 |
| 4,115,857 | 9/1978 | Panetti | 51/178 |
| 4,178,724 | 12/1979 | Bruno | 51/178 |

FOREIGN PATENT DOCUMENTS

| | | |
|---|---|---|
| 614476 | 11/1979 | Switzerland . |
| 633336 | 11/1982 | Switzerland . |

*Primary Examiner*—Roscoe V. Parker

*Attorney, Agent, or Firm*—Robert E. Burns; Emmaneul J. Lobato; Bruce L. Adams

[57] ABSTRACT

This machine comprises at least one grinding unit mounted to a grinding base. Each unit comprises a frame secured to the grinding base. The grinding wheel is driven by an electric motor, suspended from the frame by means of four rocker arms constituting two parallel-motion suspension systems. The lower rocker arms are levers of the first order and the grinding pressure is applied for one of the rocker arms by the piston rod of a hydraulic cylinder rigid with the frame and adapted to position the grinding wheel in relation to the rail, and for the other rocker arm by the piston rod of a pneumatic cylinder also rigid with the frame. This pneumatic cylinder determines the operating pressure of the grinding wheel on the rail. The operative face of the grinding wheel is parallel to the plane of the theoretical tangent to the rail profile. A right-angled lever is pivoted to a projection of the frame and provided at one end with a stud facing the grinding wheel. During the forward feed of the grinding wheel this stud moves from an inoperative position to the theoretical tangent and when this theoretical tangent is attained by the wheel the opposite end of the right-angled lever actuates a device for stopping and locking the feed of the grinding wheel by actuating the hydraulic positioning cylinder.

10 Claims, 8 Drawing Figures

MACHINE FOR RESHAPING RAIL HEADS

BACKGROUND OF THE INVENTION

The present invention relates in general to the art of reshaping the heads of railway track rails and has specific reference to a machine for reshaping rail heads which comprises one or a plurality of grinding units adapted to operate along one running rail, with means for positioning and feeding the cutting tool or tools in relation to the head, the grinding unit or units being disposed around the rail head for the purpose of grinding one or several faces corresponding to theoretical tangents along one and/or a plurality of generatrices of the theoretical cross-section of the rail.

THE PRIOR ART

For reshaping the rails of railway tracks which have undergone a marked distortion due to prolonged and heavy traffic conditions, it is necessary on the one hand to remove the waves formed on the rail top and on the other hand to eliminate the beads formed on either side of the head. As a rule, grinding machines are used for reshaping the running surface grinding and trimming machines are used for removing beads. Such trimming machines provided with inclined grinding wheels remove at each pass an amount of metal which is proportional to the pressure exerted thereon through the machine.

To obtain an accurate reshaping of rail heads the grinding wheel must be guided and positioned with respect to the axis, the running or top face P1 (FIG. 1) and the inner side face P2 of the rail, so that the theoretical tangent T to the desired or theoretical cross-section can be obtained. Of course, for reshaping the head rail completely, several grinding wheels set in different angular positions in a plane extending across the track are used, these wheels being guided for obtaining a plurality of faces constituting the theoretical tangents T1,T2,T3, etc. along corresponding generatrices G1, G2,G3, etc. of the rail head.

A machine designed for this purpose is disclosed in the Swiss Pat. No. 633,336. A rail head grinding vehicle is provided with two groups of grinding units, each group operating on one running rail of the track. Each group comprises four grinding units or heads constituting a grinding shoe suspended from the frame structure of the vehicle. Two opposite shoes, i.e. one on each running rail, have their central portions interconnected by a coupling member. Each shoe is movable angularly in a plane extending across the track so that the angular setting of the grinding units can be modified and the complete rail head can be ground in several passes. According to a modified form of embodiment, each grinding unit is provided with means enabling the unit to pivot independently of the other grinding units of the shoe and in a direction parallel to a transverse plane of the track, thus enhancing the possibilities of approaching the rail head cross-section. Means are provided for changing step by step the angular position of the shoes and/or of the grinding units. A fluid-actuated cylinder and a pair of poles pivotally mounted to a bracket fastened to the bottom of the vehicle frame constitute the suspension system of each grinding shoe, the cylinder being adapted on the one hand to retract the shoe when the vehicle is running light and on the other hand to adjust the pressure exerted by the shoe on the running rail. Each grinding unit is adjustable separately in the vertical direction with respect to the grinding show by means of a slideway.

An optimal approach of the theoretical curvature of the rail head cross-section is made possible by the possibility of adjusting on the one hand the shoe inclination and on the other hand the angular setting of each grinding unit in relation to the shoe. The grinding units of an assembly constituting a single and same shoe are pressed bodily against the rail without any possibility of controlling separately the feed of each wheel which, of course, is adjustable vertically in relation to the other wheels. This adjustment is obtained by means of a screw driven by a control handwheel actuated before beginning the grinding operation proper, and cannot be modified during the machine feed. On the other hand, no means are described for controlling the shoe position except the lifting cylinder which is also intended for adjusting the pressure exerted by the shoe on the rail. The shoe system may prove satisfactory provided that the generatrices are relatively close to each other. In this case, the waves are eliminated as a function of the shoe length, i.e. the extreme distance between the grinding units. In case the generatrices are relatively spaced from one another, it is difficult to properly control the operation, and the grinding wheels tend to copy or reproduce the waves on the burrs, since the rail is no more guided.

Another Swiss Pat. No. 614,476 also discloses a machine for grinding the running face of rails, which comprises servo means for controlling the feed of the cutting tool as function of the magnitude of the waves and also of the tool wear, but not as a function of the theoretical tangent of the rail head cross-section.

SUMMARY OF THE INVENTION

It is the primary object of the present invention to avoid the inconveniences of prior art machines as set forth hereinabove by providing a machine capable of preventing the grinding of the rail head cross-section beyond the theoretical tangent of the desired theoretical contour.

The machine according to the present invention is characterized by the fact that each grinding unit comprises a member disposed in the plane of the face, or in a plane parallel thereto, for detecting the ingress of the cutting or grinding tool in the plane of the theoretical tangent and controlling the locking of the means for positioning and feeding the tool against the rail head when this plane corresponding to the theoretical tangent is attained.

The advantages obtained with the present invention consist in that the cutting tool cannot be fed beyond the plane of the predetermined theoretical tangent, thus preventing any grinding of the rail beyond or short of this plane, so that an optimal approach of the desired cross-section is safely obtainable. A tilting mechanical stop member may be disposed in front of the cutting tool, and at the end of its tilting movement, as a consequence of the tool feed, the feed of the grinding unit is stopped, the position of said stop member being such that at the end of its tilting movement the operative face of the tool lies exactly in the plane of the theoretical tangent. The stop member operates directly or indirectly through the medium of a proximity feeler, a hydraulic or pneumatic valve controlling the supply of fluid under pressure to a positioning cylinder.

According to a modified form of embodiment, a pneumatic feeler is substituted for the above-mentioned mechanical stop member, so that the air jet emitted by this feeler is directed toward the theoretical tangent and when the cutting tool is in front of the jet orifice emitting this air jet the latter is disturbed and the detection of this disturbance causes the actuation of the locking valve of the positioning cylinder.

Grinding units are used mainly in groups and connected to a grinding base guided on the one hand in the vertical median plane of the rail (i.e. the longitudinal plane containing the axis of symmetry of the rail cross-section), and on the other hand vertically by bearing on the rail surface, for example by means of rollers or shoes. The grinding units supported by this base are set in different angular positions in a plane across the rails, i.e. perpendicular to the longitudinal direction of the rails.

According to another modified form of embodiment of the invention, the angular setting of each unit can be modified either step by step between two predetermined limit values, or by taking one or the other of two predetermined values.

According to a further modification of the invention the angular setting of each grinding unit is changed independently of the other units, and in a further modified version the units of a grinding base are mounted in mutually rigid relationship so that the change in the angular setting is effective for all the units, the angular relationships between the units remaining constantly the same.

THE DRAWINGS

Figure 2:
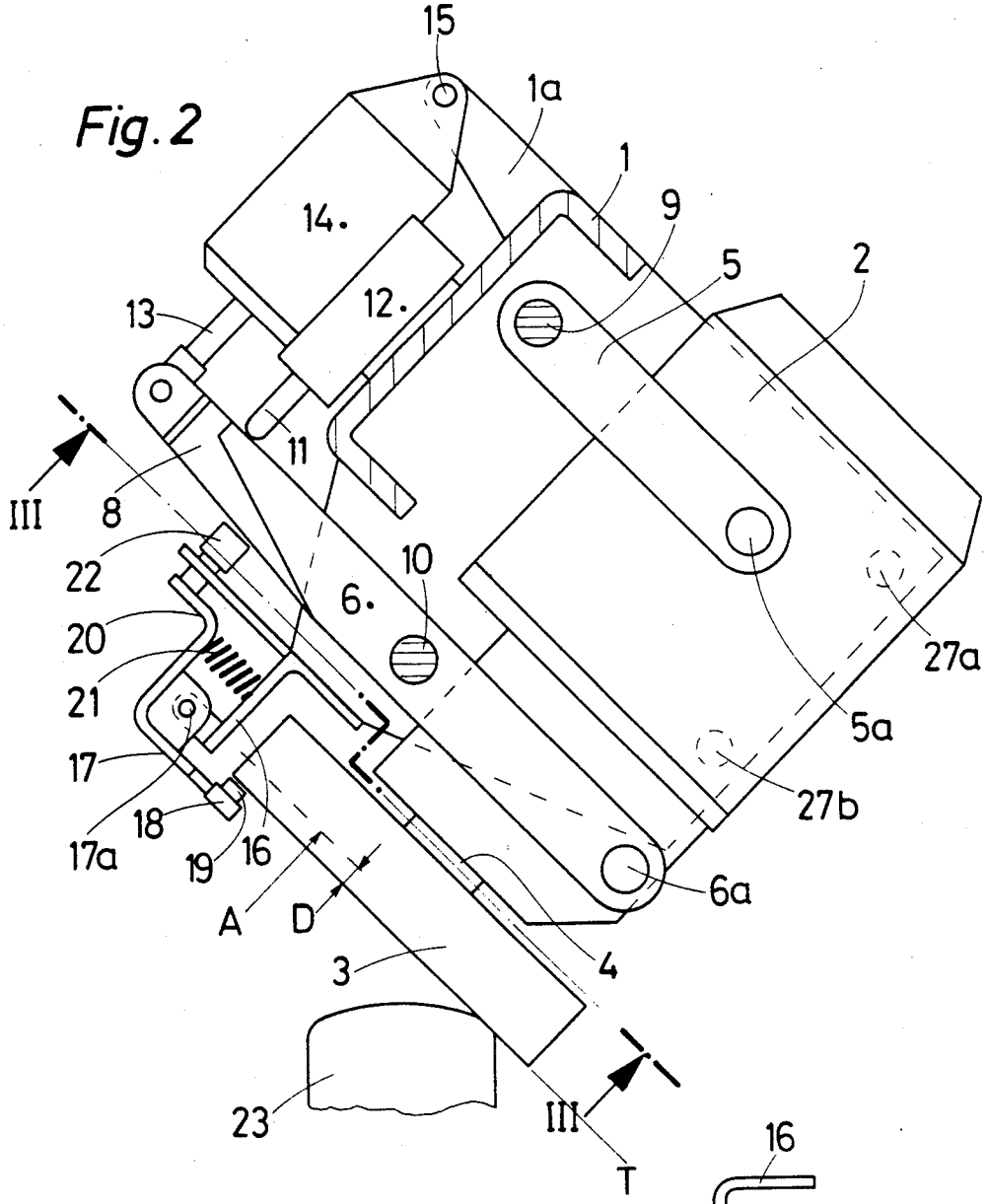
FIG. 2 is a part-sectional and side-elevational diagrammatic view of a grinding unit as seen in the direction of the arrows II—II of FIG. 3.
Figure 2A:
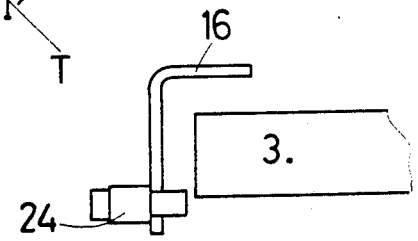
Figure 3:
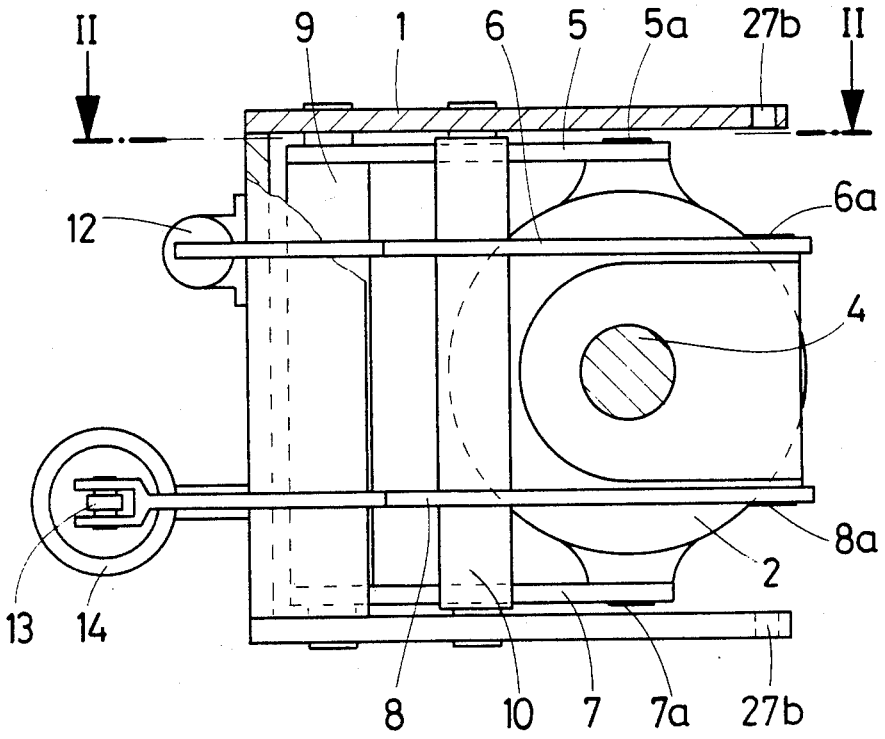
Figure 4:
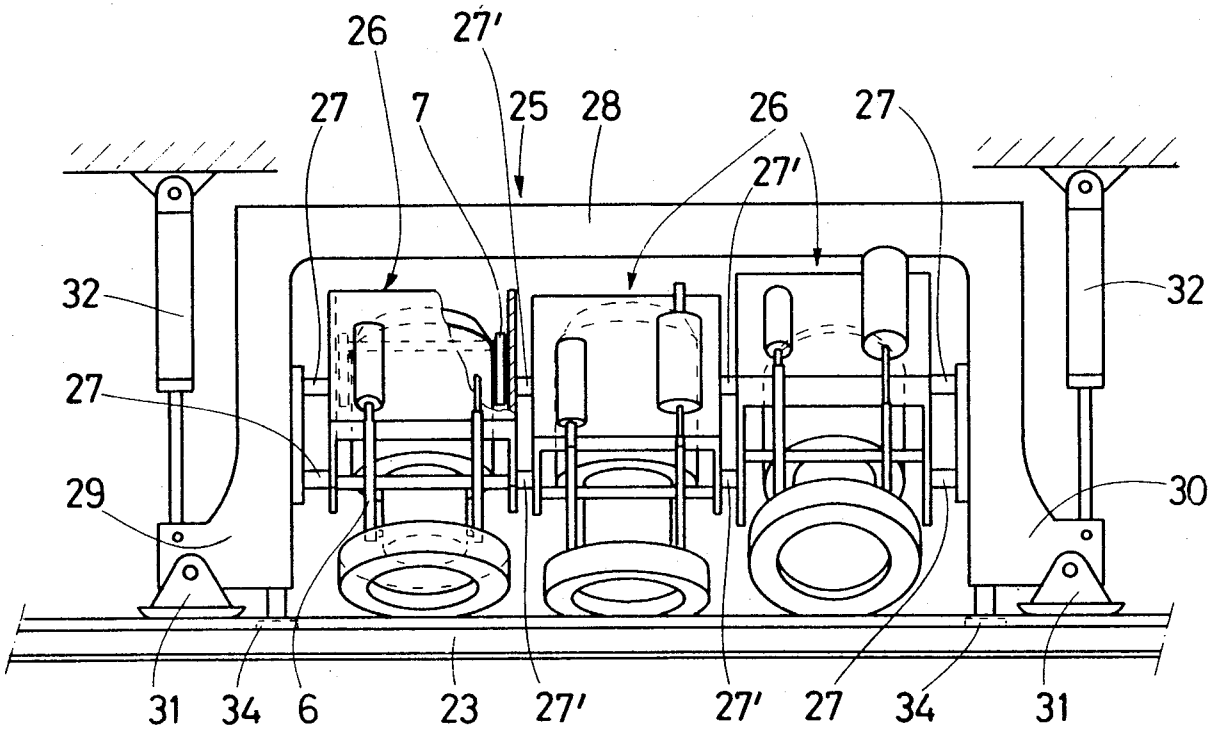
Figure 5:
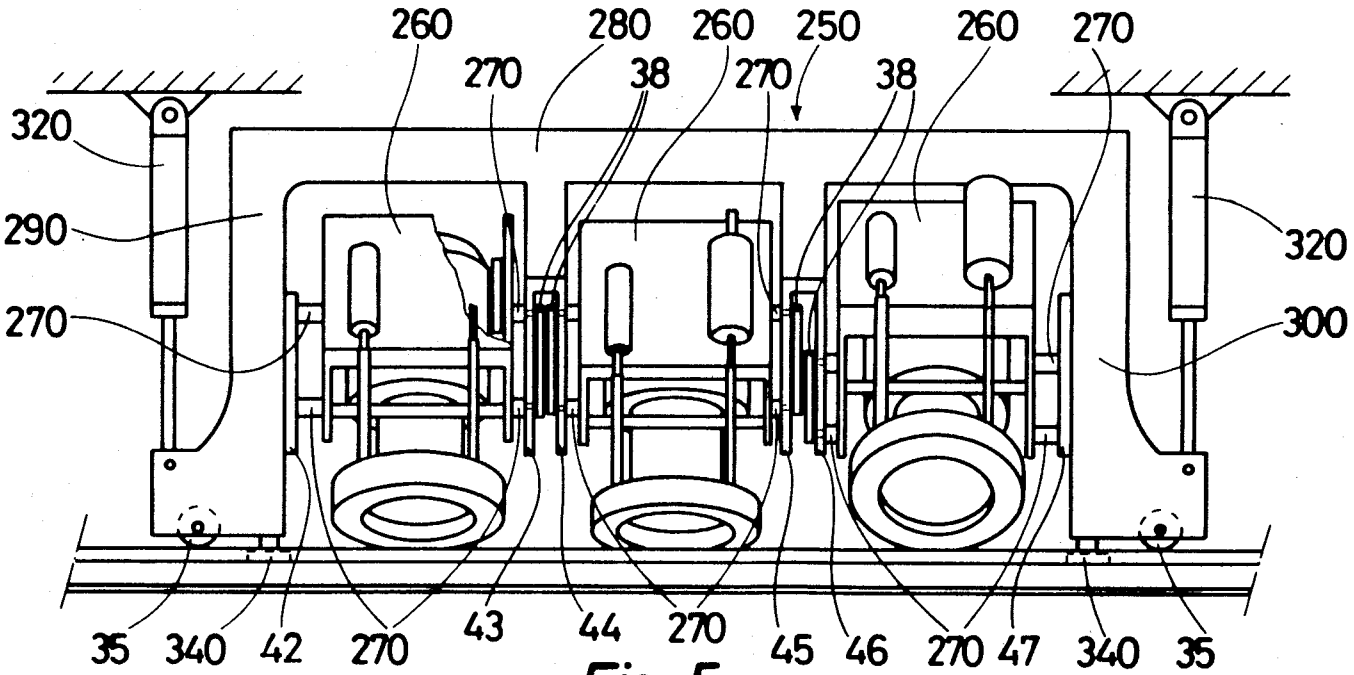
Figure 6:
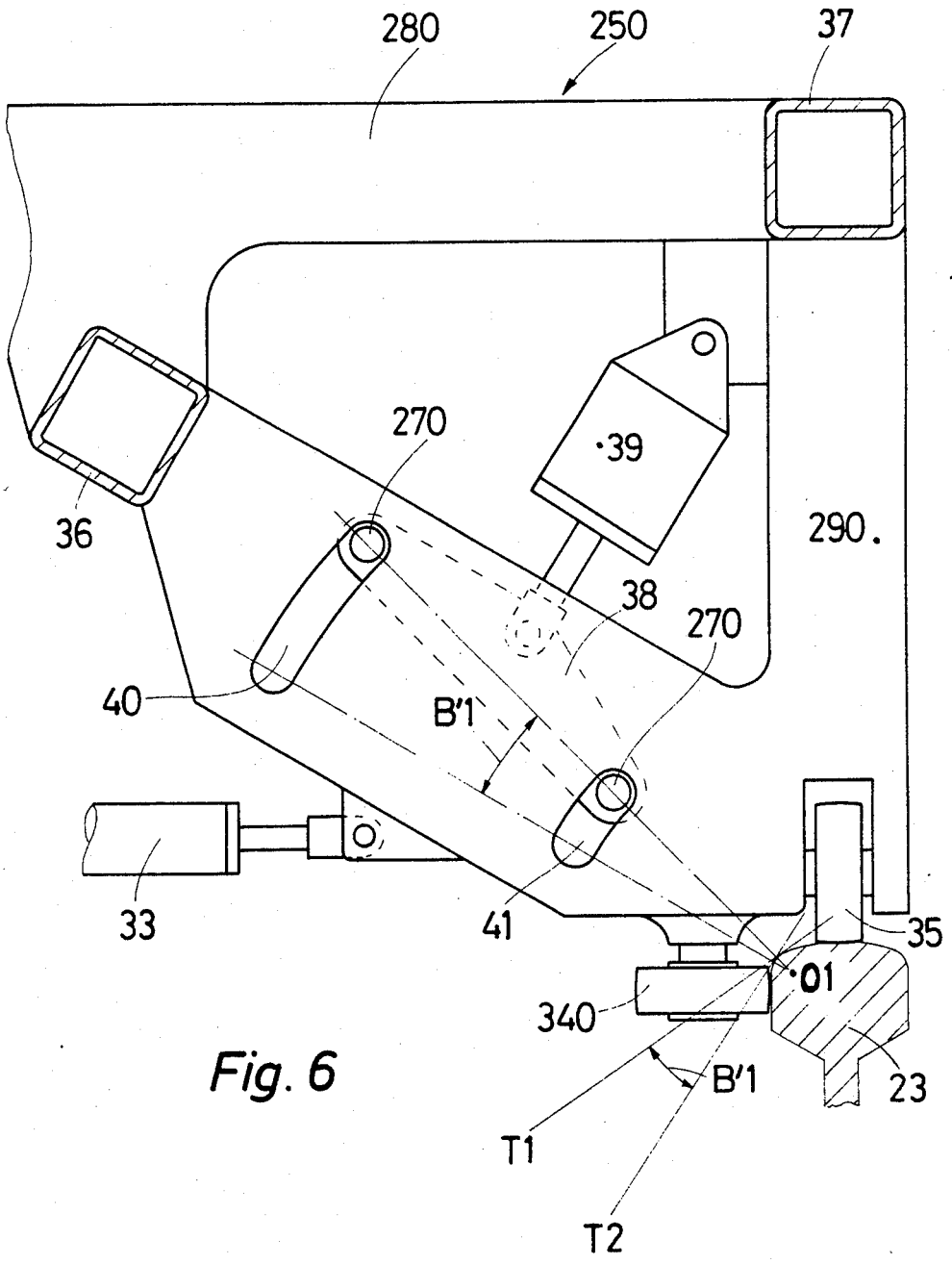
Figure 7:
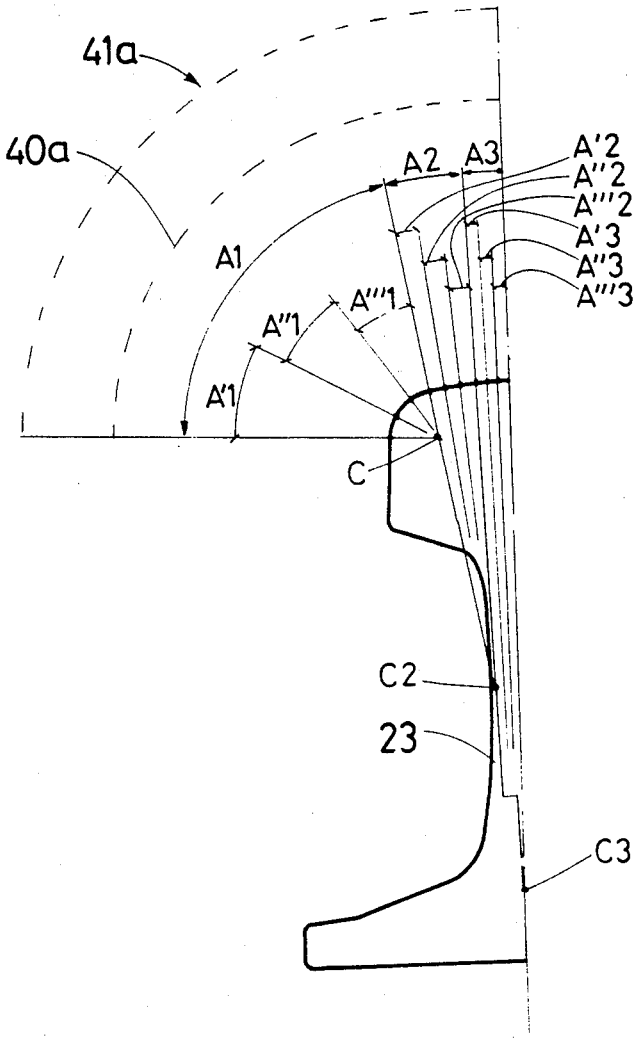

FIG. 2*a* illustrates a modified detail of the grinding of FIG. 2;

FIG. 3 is a view taken in the direction of the arrows III—III of FIG. 2;

FIG. 4 is a diagrammatic side-elevational view of a grinding base, the grinding units being rigidly assembled with one another;

FIG. 5 is a view similar to FIG. 4 wherein the angular setting of each grinding unit of the grinding base can be modified separately from the others;

FIG. 6 is a diagrammatic front elevational view of a grinding base incorporating the device for modifying the angular setting of the grinding units, some component elements of the assembly having been omitted for the sake of clarity; and FIG. 7 is a fragmentary side-elevational view of a rail cross-section showing the centres and radii of curvature.

DESCRIPTION OF THE PREFERRED EMBODIMENTS

Each grinding unit or head (FIGS. 2,3) comprises a frame 1 having two pairs of holes 27*a*, 27*b* formed therethrough for mounting to a grinding base installed on a rail grinding vehicle an electric motor 2 drivingly supporting the cutting tool consisting in this example of a grinding wheel 3 driven through the motor output shaft 4, the motor 2 being suspended from the frame 1 by means of four links 5,6,7,8 forming a pair of parallel motion systems 5,6 and 7,8. Links 5 and 7 are pivoted at one end to a pin 9 rigid with the frame 1 and at the opposite end ot the motor casing 2 via pivot pins 5*a* and 7*a*, respectively. Links 6,8 are in fact levers of the first order fulcrumed intermediate their ends to a pin 10 rigid with the frame 1 and at one of their ends 6*a*, 8*a* to the motor casing 2. The other end of link 6 engages the protruding end of the piston rod 11 of a cylinder 12, preferably of the hydraulic type, rigidly secured to the frame 1, the other end of lever 8 being pivotally connected to the rod 13 of another preferably pneumatic cylinder 14 suspended by means of a pin 15 from a projecting arm 1*a* rigid with the frame 1. The first cylinder 12 is the grinding wheel positioning cylinder and the other cylinder 14 is the grinding-force regulating cylinder, i.e. the cylinder for adjusting the pressure exerted by the tool on the rail. Of course, it would be possible to combine these two cylinders into a single cylinder; however, if an accurate positioning is desired or necessary it is better to provide a hydraulic cylinder of which the sole function is to position, not to adjust the working pressure.

Another projecting arm 16 rigid with the frame which is parallel to the side faces of grinding wheel 3 carries a pivot pin 17*a* to which a lever 17 bent at right angles is fulcrumed inside its corner, so that its one end 18 faces the outer peripheral portion of the operative face of grinding wheel 3. This end 18 is provided with a stud or feeder 19 made from a material having a greater resistance to abrasion than the material of grinding wheel 3. The other end 20 of lever 17 carries another stud 19*a* substantially perpendicular to the adjacent lever arm, a coil compression spring 21 constantly urging the right-angled lever 17 in the counter-clockwise direction as seen in FIG. 2 so that the stud 19 is normally held in its inoperative position in the plane A (in dash lines) and engages a stop member (not shown). The stud 19*a* carried by the other end 20, when the right-angled lever 17 urged by the grinding wheel 3 is pivoted in the clockwise direction as seen in FIG. 2, engages a valve 22 controlling the hydraulic circuit of cylinder 12 so as to stop the outward stroke of rod 11 and consequently the feed of wheel 3. From the time the grinding wheel 3 engages the stud 19 to the time the valve 22 is actuated, the grinding wheel 3 is fed through a distance D. At the end of the tilting movement of lever 17 the end of stud 19 and consequently the operative surface of wheel 3 lie on the theoretical tangent T to the theoretical contour of the rail head 23.

In a modified form of embodiment a proximity detector may be substituted for the valve 22 for detecting the approach of the end 20 of lever 17 and thus control via an electro-hydraulic or electro-pneumatic circuit the turning off of the supply of fluid to cylinder 12.

In a third modified form of embodiment illustrated in FIG. 2*a* a proximity detector 24, notably of the pneumatic type, may be substituted for the tilting lever 17. In this case, the pneumatic detector 24 delivers through a nozzle a jet of compressed air in a direction parallel to the operative surface of grinding wheel 3, this nozzle being located exactly on the theoretical tangent T. When the lateral face of wheel 3 approaches the nozzle, the air jet is disturbed and this abnormal condition is detected by an electro-hydraulic or electro-pneumatic circuit controlling as in the preceding case the positioning cylinder 12.

Obviously, it is irrational to utilize only one grinding wheel for reshaping a single running rail. Usually, several wheels are assembled and set at different angles in relation to a grinding base provided with shoes or rollers for guiding grinding wheels in relation to the median plane of the rail.

Figure 1:
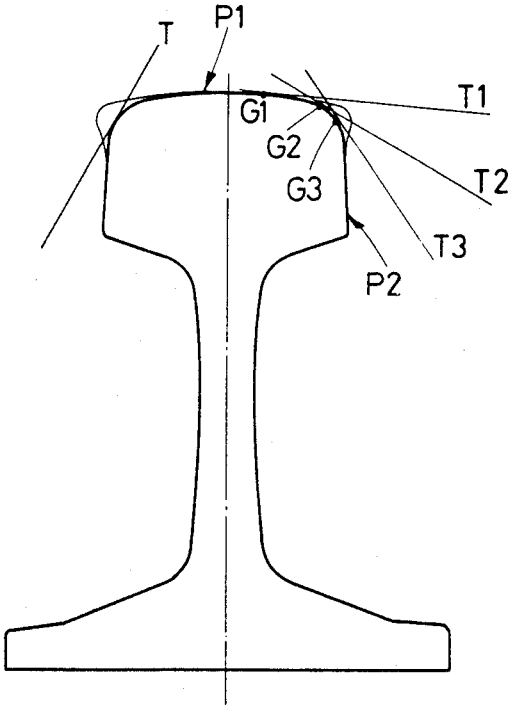
FIG. 1 is a cross-sectional view of a rail head having undergone a pronounced distortion.

FIG. 4 illustrates very diagrammatically a grinding base 25 comprising three grinding units 26, each grinding unit 26 corresponding to the unit shown in FIGS. 1 and 2.

The three grinding units 26 are rigidly interconnected by means of rods 27' and the end or outermost units of each three-unit assembly are secured to the base 25 by means of guide rods 27 fastened to orifices 27*a* and 27*b* formed in their relevant frame 1 (see FIGS. 2 and 3). Each grinding unit is locked in a different angular position with respect to the other units so that the rail head can be reshaped in a single pass along three generatrices G1,G2 and G3 (FIG. 1) by forming tangential faces containing the corresponding theoretical faces T1,T2 and T3. If a single pass is not sufficient for attaining the theoretical tangents, if necessary two or more passes are made until the desired cross-sectional contour is obtained. The frame 28 of base 25 is supported by a pair of uprights 29,30 provided with a pair of shoes 31 engaging the top face or running face of rail 23. This unit is suspended by means of a pair of double-acting cylinders 32 adapted on the one hand to retract the base 25 when the vehicle is running light, and on the other hand to keep the shoes 31 in firm and permanent contact with the rails during the grinding operation. Moreover, as illustrated by the modified form of embodiment shown in FIGS. 5 and 6 of the drawings, the shoes 31 may be replaced by rollers 35. Fluid-actuated cylinders of the type designated by reference numeral 33 in FIG. 6 are also provided for guiding the base 25 in the horizontal plane by urging the rollers 34 against the inner side face of the rail head.

The grinding units or heads 26 may be mounted to the frame 28 in two ways: in the first way, these heads or units are constantly kept in a fixed angular relationship to one another (FIG. 4) and in this case it is either impossible to change the angular setting of the units, or possible to change the angular position of the three units 'en bloc'; in the other way, the angular setting of each grinding gead or unit can be modified independently of the other heads or units, as illustrated in FIG. 5 to which reference will be made presently.

When it is desired to change the angular operative position of the grinding units or heads carried by a base, whether separately or 'en bloc' or one unit, care must be taken that the operative face of the cutting tool be disposed parallel to the theoretical plane tangent to the theoretical rail contour. For the sake of clarity, FIG. 7 illustrates one-half of the theoretical contour of a rail head. It is assumed that one or the other half of the cross-section of the head of a rail 23 is obtained by interconnecting three circular arcs of which the angular extents are denoted A1,A2 and A3, the centres of these arcs being designated by symbols C1,C2 and C3, respectively. For properly reshaping the rail head, a grinding unit or head must be so guided during the change in its angular setting that two fixed points of the grinding unit lie on a straight line parallel to the grinding wheel driving spindle moving along two paths homothetic to the curvature of the rail head contour. FIG. 7 illustrates these two paths in the form of two dash lines 40*a* and 41*a*, however without taking account of the proportions between the dimensions of the cross-sectional contour of rail head 23 and the actual distances both between these paths and between the rail 23 and said path 40*a* and 41*a*. It is quite obvious that the quality of the reshaping work is proportional to the number of faces ground by the grinding wheels. Theoretically, one may use only one grinding unit for producing several faces approaching the theoretical cross-section of the rail head. In this case the angular setting of the grinding unit may be modified as many times as desired and necessary from one to the other end or side of the rail head contour, provided that care is taken to guide two fixed points of the grinding unit as mentioned hereinabove along two paths 40*a* and 41*a*. Since the use of a single grinding head or unit is not rational, each one of the bases utilized comprises at least two grinding units or heads and in the present case a three-unit base (FIGS. 4 and 6) is used by way of example. The possibilities of changing the angular setting of the grinding units or heads of a same base are as follows:

(i) If the grinding units are so mounted that the angular difference between their positions cannot be changed, as illustrated in FIG. 4, the variation in the inclination of the assembly of grinding units or heads is such that the three units constantly remain inside the arc A1 or A2, or A3. In this case the first unit is so disposed that it remains inside the Arc A'1, respectively A'2, respectively A'3, the second unit remains inside the arc A''1, respectively A''2, respectively A''3, and the third unit remains inside the arc A'''1, respectively A'''2, respectively A'''3.

(ii) If the grinding heads or units are so mounted that the angular setting between them can be modified, as illustrated in FIG. 5, two possibilities arise:

(a) The first unit or head remains inside the arc A1, the second unit remains inside arc A2 and the third unit remains inside arc A3, when their angular setting is changed.

(b) The inclination of each unit or head can vary within the total arc A1+A2+A3.

FIG. 6 illustrates the means provided for changing the angular setting of a grinding wheel or of multiple units or heads mounted to a grinding base, as shown in FIG. 4, which is a front view corresponding to FIG. 5 except for certain component elements omitted for the sake of clarity. The base illustrated in FIG. 5 departs from that of FIG. 4 by the fact that the grinding heads or units are so mounted that their angles of inclination can be adjusted separately. Moreover, a roller 35 is substituted for the shoe 31. The same reference numerals followed by '0' are used for designating the elements of FIG. 5 which correspond to those of FIG. 4.

Before describing the manner in which the grinding units are mounted, a brief description of the means provided for modifying the angular setting of the unit or head illustrated in FIG. 6 will be given. The frame 280 bears through the medium of rollers 35 on the running face of the rail 23 to be reshaped and is guided horizontally by fluid-actuated cylinder 33 and rollers 340. The frame 280 comprises essentially a pair of tubular beams 36 and 37 assembled by metal sheets having a triangular cross-section when seen in front view. The inclination of a grinding head or unit 260 can be modified by means of studs 270 carried by the ends of a rocker arm 38 (shown in dash lines in FIG. 6) suspended through a fluid-operated cylinder 39 from the frame 280 of the base. The two studs 270 are guided by engaging arcuate slots 40,41 corresponding to the lines 40*a* and 41*a* of FIG. 7. More particularly, these arcuate slots 40 and 41 are circular arcs centered to a point 01 which is the centre of curvature of a circular arc on the rail head defined by the two tangents T'1 and T'2 forming an angle B'1 corresponding to the angle formed between the two extreme positions of the grinding unit or head, this angle being for example of the order of 10 degrees.

The slots 40 and 41 may correspond to one of the arcs A1,A2,A3 of FIG. 7 of lines 40*a* and 41*a*, or to the whole of arm A1+A2+A3, as already briefly mentioned in the foregoing, and in this case the slots 40 and 41 correspond to one portion of one of these arcs, so that the grinding units remain inside arcs A'1,A''1,A'''1 or A'2, A''2,A'''2, or A'3,A''3,A'''3, respectively.

Since the heads or units 26 are rigid with one another the fixing rods 27 of the end units 26 are guided in slots 40 and 41 and supported by a rocker arm 38 and a fluid-actuated cylinder 39, as illustrated in FIG. 6.

In the specific case of the base illustrated in FIG. 5 each grinding unit or head 260 is suspended from the frame 280 of base 250 by means of a device similar to the one shown in FIG. 6. Thus, each unit 260 is suspended by means of rods 270 engaging slots formed in plates 43,44 and 45,46 secured to the frame 280, as shown in FIG. 6. Two plates designated by reference numerals 42 and 47 are secured to the back face of posts 290 or 300 of base 250. The slots formed in each pair of plates 42,43 or 44,45 or 46,47 correspond to one of said arcs A1,A2-,A3 respectively (FIG. 7), or to the total of said arcs A1+A2+A3. The guide rods 270 are interconnected by rocker arms 38 suspended from, and driven by, fluid-actuated cylinders 39 (not shown).

The angular setting of a grinding unit or head (FIG. 5) or of an assembly of units or heads (FIG. 4) may be modified between two limit values either step by step, the drive being derived for example from a motor, or by using means capable of giving two predetermined values to the inclination of the grinding unit or head. Thus, for example, this last case is applicable to a base of the type shown in FIG. 4, having its grinding heads set at 70°, 50° and 40° respectively, and after modifying this angular position by means, for instance, of the device of FIG. 6, the angular setting of the grinding units or heads is 60°, 40° and 30°, respectively.

To sum up, a grinding base may consist of one or a plurality of grinding heads or units, and in the case of a multi-headed base the angular setting may be either changed for all the grinding heads simultaneously or independently of each other, or these units or heads are mounted in a predetermined fixed position on the base.

What is claimed is:

1. A machine for reshaping rail heads which comprises a support structure, at least one grinding unit mounted on said support structure, said grinding unit comprising a grinding wheel, having an operative face for engagement with a rail head to form thereon at least one ground face according to a theoretical tangent along at least one generatrix of the theoretical cross section of the rail head, means for driving said grinding wheel, means for positioning said grinding wheel with respect to the rail head including means for moving said grinding wheel toward and away from the rail head, means coacting with the operative face of said grinding wheel for sensing the position of the operative face of said grinding wheel and means responsive to said sensing means for controlling said positioning means to position the operative face of said grinding wheel in the plane of said theoretical tangent of said rail head.

2. A machine according to claim 1, in which said sensing means comprises feeler means engageable by the operative face of said grinding wheel.

3. A machine according to claim 2, in which said positioning means comprises fluid pressure for moving said grinding wheel toward and away from the rail head and said means for controlling said positioning means comprises valve means controlled by said feeler means and controlling the supply of pressure fluid to said fluid pressure means.

4. A machine according to claim 3, in which said fluid pressure means comprises hydraulic means for positioning said grinding wheel relative to the rail head and pneumatic means for pressing said grinding face of said grinding wheel against the rail head.

5. A machine according to claim 2, in which said positioning means comprises fluid pressure means for moving said grinding wheel toward and away from the rail head and said means for controlling said positioning means comprises a proximity detector associated with said feeler means for detecting the position of said feeler means when said plane of the theoretical tangent is attained and controlling valve means for supplying fluid to said fluid pressure means.

6. A machine according to claim 1, in which said sensing means comprises a pneumatic detector positioned to detect the position the operative face of said grinding wheel and controlling said positioning means.

7. A machine according to claim 1, in which a plurality of said grinding units are mounted on a grinding base with the operative face of the grinding wheel of each grinding unit disposed parallel to a plane of a different theoretical tangent of said rail head, said grinding base being provided with means for guiding it parallel to the rail axis and to the vertical median plane of the rail.

8. A machine according to claim 7, in which said grinding units are rigidly assembled with one another at different angles of inclination relative to one another, said grinding base being provided with means for varying the inclination of the assembly of grinding units with respect to a plane perpendicular to the rail about a predetermined center of curvature of a theoretical cross sectional contour of the rail head, to permit the successive grinding of at least two faces approaching a circular arc corresponding to said center of curvature.

9. A machine according to claim 8, in which said means for varying the inclination of the assembly of grinding units comprises guide rods on which said grinding units are mounted and mounting plates secured to said grinding base and having arcuate slots in which said guide rods are movable.

10. A machine according to claim 7, in which said grinding units are mounted on said base independently of one another, each grinding unit comprising means for varying its angle of inclination in a plane perpendicular to the rail about a center of curvature of circular arc constituting the cross sectional contour of the rail head.

* * * * *